United States Patent [19]

Daley

[11] Patent Number: 4,765,424

[45] Date of Patent: Aug. 23, 1988

[54] APPARATUS FOR TRANSPORTING A SUSPENSION CRADLE

[75] Inventor: Edward Daley, Nelson, United Kingdom

[73] Assignee: Colebrand Limited, London, England

[21] Appl. No.: 914,880

[22] Filed: Oct. 3, 1986

[30] Foreign Application Priority Data

Oct. 3, 1985 [GB] United Kingdom ..... 8524450

[51] Int. Cl.[4] ..... B62D 11/06; E04G 1/20

[52] U.S. Cl. ..... 180/8.1; 182/13; 182/36

[58] Field of Search ..... 180/8.1, 8.5, 8.7; 182/12, 13, 36

[56] References Cited

U.S. PATENT DOCUMENTS

| | | | |
|---|---|---|---|
| 3,059,721 | 10/1962 | Straw | 182/13 |
| 3,076,522 | 2/1963 | Goodell | 182/36 |
| 3,522,859 | 8/1970 | Thring | 180/8.7 |
| 3,534,832 | 10/1970 | Rediske | 182/13 |
| 3,854,550 | 12/1974 | Shingler | 182/36 |
| 3,991,842 | 11/1976 | Larsen | 180/1 VS |
| 4,088,202 | 5/1978 | Costello | 182/13 |
| 4,475,611 | 10/1984 | Fisher | 182/13 |

*Primary Examiner*—John J. Love
*Assistant Examiner*—Donn McGiehan
*Attorney, Agent, or Firm*—Lowe, Price, LeBlanc, Becker & Shur

[57] ABSTRACT

The invention relates to a suspension cradle or cradles which can be transported along an upper region such as the rim of an upright edifice such as a cooling tower, the rim having a substantially flat surface extending on a plane transverse to the upright plane of the cooling tower, transportation of the cradle(s) being by a device mounted on the surface by means adapted to move the device along the surface.

7 Claims, 4 Drawing Sheets

APPARATUS FOR TRANSPORTING A SUSPENSION CRADLE

TECHNICAL FIELD

The invention relates to apparatus for transporting a suspension cradle along an upper region of an upright edifice such as a cooling tower, chimney, column or the like, which edifice has a substantially flat surface extending in a plane transverse to an upright plane of the edifice.

BACKGROUND ART

The usual method of transporting a suspension frame is the use of wire ropes installed by steeplejacks.

This method also requires anchors drilled into the edifice (e.g., cooling tower).

When an obstacle is encountered the suspension frame jams. When this occurs it is necessary for a steeplejack to physically lift the suspension frame over the obstacle with the aid of a crow bar. This operation can be both time consuming and dangerous.

DISCLOSURE OF INVENTION

According to this invention there is provided apparatus for transporting a suspension cradle along an upper region of an upright edifice having a substantially flat surface extending in a plane transverse to the upright plane of the edifice, including a device mounted on the surface by means adapted to move the device along the surface.

Such moving means preferably includes pairs of extensible members which are extended in pairs alternately to engage the surface for moving the device along the surface.

In one embodiment, there are two pairs of extensible members, one pair being carried by a first frame of the device and the other pair being carried by a second frame of the device. The two frames can be operatively connected for relative movement.

One frame is preferably mounted within the second frame part and operatively connected thereto by a roller and guide arrangement for relative sliding movement.

The one frame part comprises a carriage having roller bogies one of which is connected to a drive pinion, and the rollers of the bogies may run in longitudinally extending inwardly facing channel guide members of the second frame part so that when the pinion is rotated by a drive device, the first and second frame parts can slide relative to each other.

The drive device can be a manually rotatable endless member trained around the pinion and a return pulley on the cradle.

The extensible members are preferably hydraulic jacks with a pad for contacting the surface.

The jacks are connected by hydraulic lines to hydraulic actuators carried by the cradle.

The hydraulic lines can include quick release mechanisms.

The cradle can have rotatable means for engaging a boundary surface of the edifice.

The moving means can comprise motorised rotatable means.

The device can be elongate, straddling the surface with a motorised rotatable means at each end.

The motorised means preferably includes a wheel driven by an electric motor.

The motor can be reversible.

The surface can be a topmost surface of the edifice on top of a boundary surface thereof, and the device can suspend a cradle on the inside and on the outside.

The device can have a part on the inside and on the outside from which the respective cradles are suspended, there being stabilising means between each part and the edifice.

The stabilising means can comprise rotatable means.

The rotatable means preferably includes four wheels between the inner part and the edifice and four wheels between the outer part and the edifice.

The four wheels between the outer part and the edifice can be spring loaded.

The device can also include means on at least one cradle for re-charging battery means of the motors.

BRIEF DESCRIPTION OF THE DRAWINGS

Apparatus embodying the invention is hereinafter described, by way of example, with reference to the accompanying drawings.

BEST MODE FOR CARRYING OUT THE INVENTION

Figure 1:
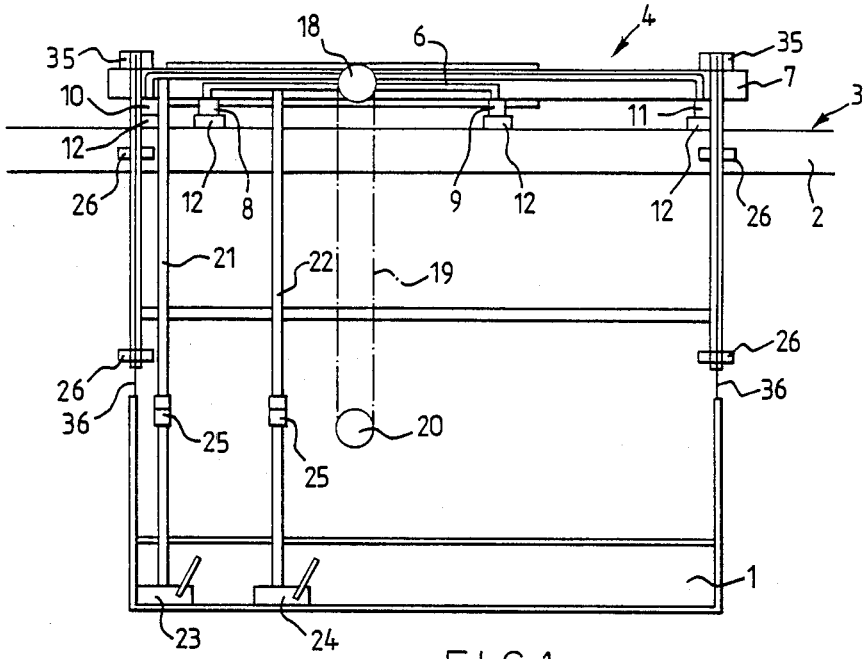
FIG. 1 is a side elevational view of a top of an edifice such as a cooling tower with one embodiment of the device according to the invention mounted thereon.
Figure 2:
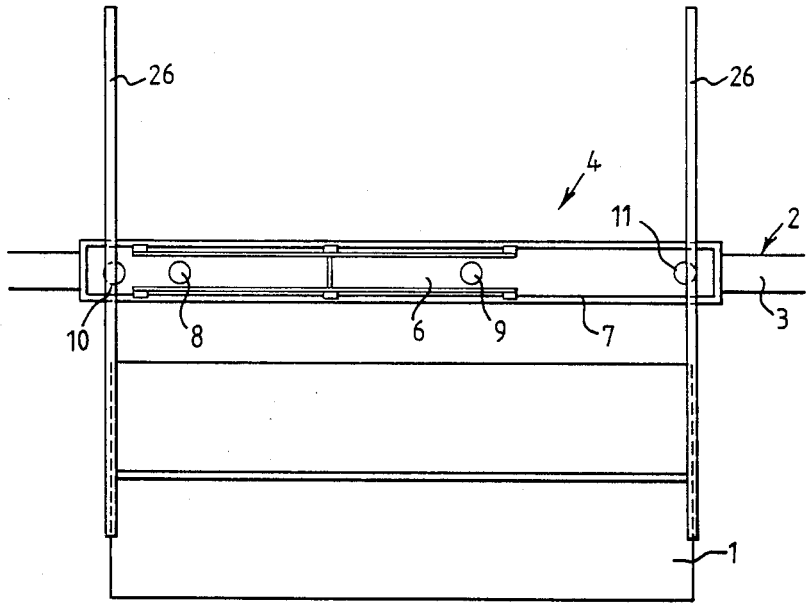
FIG. 2 is a plan view of FIG. 1.
Figure 3:
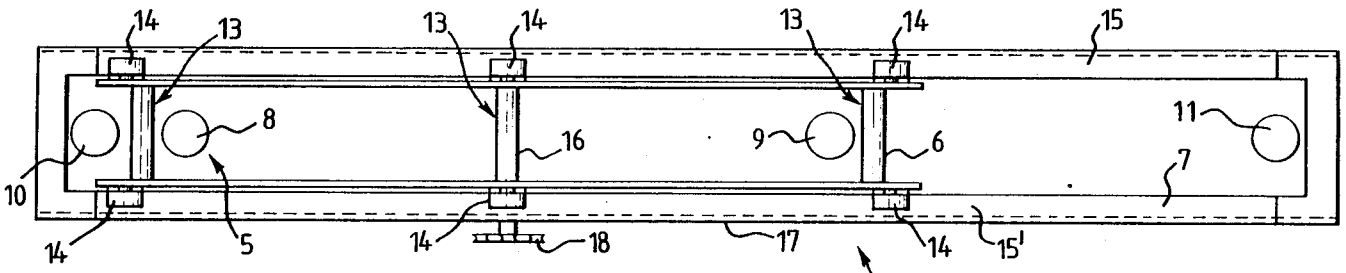
FIG. 3 is an enlarged plan view of the first embodiment of device of FIGS. 1 and 2.

The drawings (in which like parts are shown by like numerals) illustrate a suspension cradle or cradles 1 which can be transported along an upper region such as the rim 2 of an upright edifice such as a cooling tower, the rim having a substantially flat surface 3 extending on a plane transverse to the upright plane of the cooling tower, transportation of the cradle(s) 1 being by a transporting device 4 mounted on the surface by means 5 adapted to move the device along the surface 3.

Referring now to FIGS. 1–5, there is shown a first embodiment of transporting device 4 comprising two frame parts 6 and 7, the first part 6 of which is a carriage mounted within the second or outer frame part 7, and each carrying a pair of extensible members in the form of hydraulic jacks 8 and 9 and 10 and 11 each with a lower (in use, as viewed) pad 12 for engaging the surface 3 of the rim 2. The first frame part 6 comprises a carriage with roller bogies 13, there being one bogie at each end and one in the middle, the rollers 14 of the bogies 13 running in inwardly facing side channel members 15 and 15' of the second frame part 7, the rollers 14 and channel members 15, 15' forming a roller-guide arrangement. The spindle 16 on which central rollers 14 are mounted extends through a slot 17 in the channel member 15' and carries a pinion or pulley 18 round which is trained an endless drive member 19 which is also trained round a pulley 20 on the cradle 1. The jacks 8 to 11 are hydraulic jacks operated in pairs, each pair being connected by respective hydraulic lines 21,22 to respective control consoles 23,24 in the form of hand manual pumps on the cradle 1. The hydraulic lines each have a quick release coupling 25.

The suspension cradle 1 is suspended from cantilever arms 26 supported by the second frame part 7 of the device 4. The cantilever extension arms 26 could support a further cradle, the cradle 1 in FIGS. 1 to 5 being an outer cradle, that is on the outside of the cooling tower.

Figure 4:
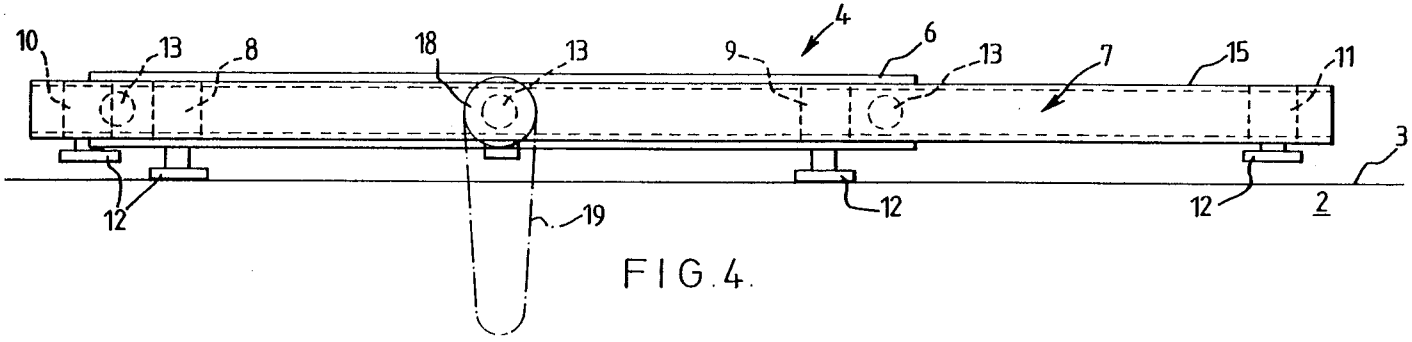
FIG. 4 is a side elevational view of the device of FIG. 3.
Figure 5:
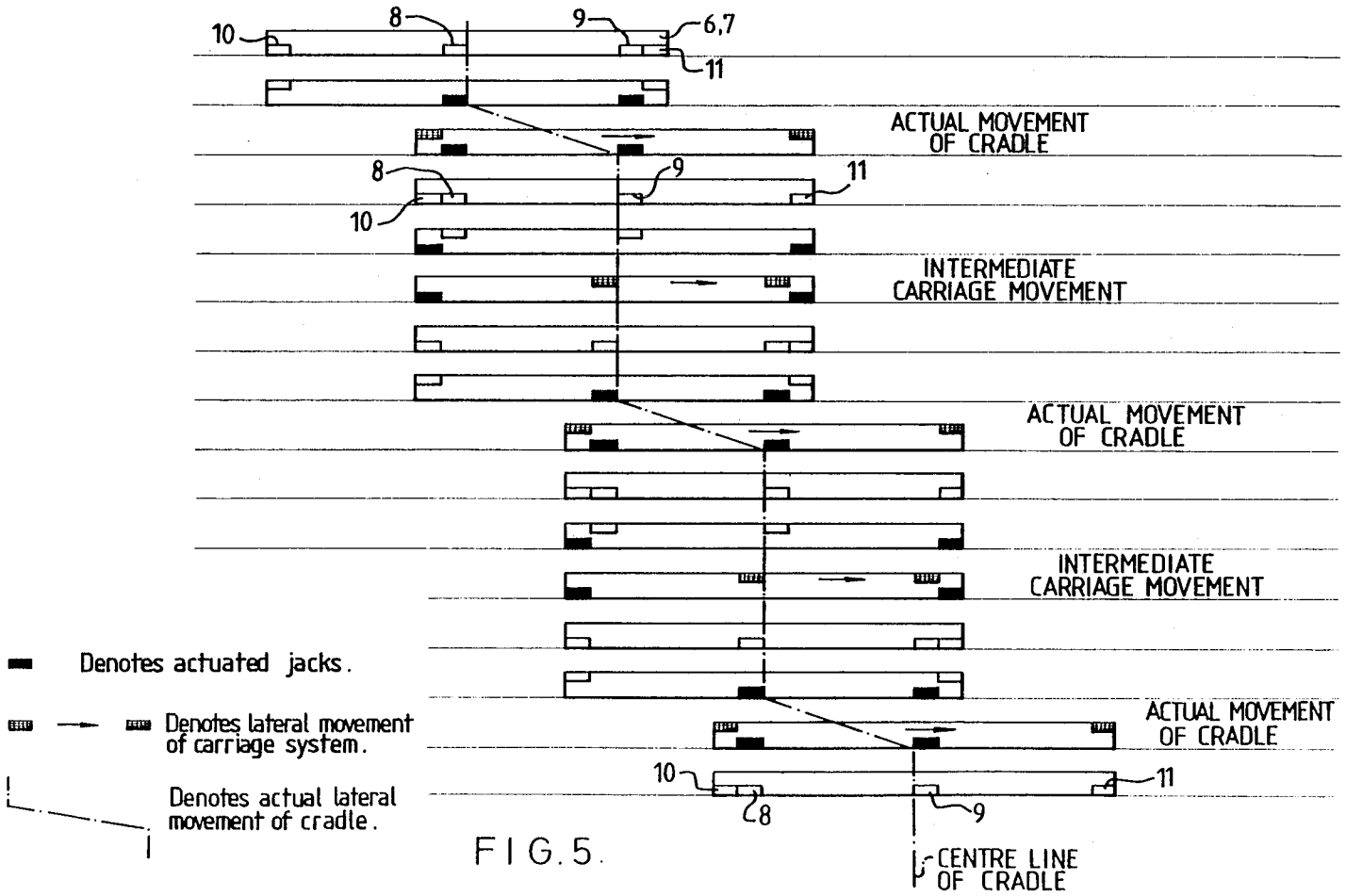
FIG. 5 shows schematically a sequence of operations of the embodiment of FIGS. 1 to 4.

In use, in order to move the cradle 1 along the tower rim 2, the pair of jacks 8 and 9 are operated and extended as shown in FIGS. 1 and 4 so that their pads 12 firmly engage and clamp on the surface 3. The jacks 10,11 are not actuated, so that the device 4, particularly the second frame part 7 is lifted clear of the rim 2. The endless member 19 or hand chain is pulled in a direction to rotate the pinion 18 in a desired direction of rotation for rotating the rollers 14 in this sense to move the device 4 in the desired direction. The movement traverses the main suspension frame or second frame part because the rollers 14 of the central bogies rotate, but the first frame part or carriage cannot move as it is clamped to the rim of the tower by its jacks 8 and 9. When the second frame part 7 has reached the end of its travel, with trailing ends of first and second frame parts 6,7 adjacent, FIG. 4, hydrualic pressure in the jacks 8 and 9 is released, which allows the second frame part 7 and the first frame part or carriage 6 to lower so that all four jacks 8 to 11 are then extended, but not the pair of jacks 8 and 9. The pads 12 of the jacks 10,11 are then in contact with surface 3 of the rim 2. By pulling on the chain 19 again, the first frame part or carriage 6 is traversed to the opposite end of the second frame part 7, in other words to the right in FIGS. 4 and 5. The jacks 10 and 11 are then released, so that the pads 12 of jacks 10,11 contact the rim 2 as the device lowers. All four jacks 8 to 11 are now, via their pads 12, in contact with the surface 3 of rim 2 as they were initially. The procedure is then repeated, so traversing the cradle 1 along the outer periphery of the cooling tower. Maintenance or other work can be carried out as desired at each location. It will be understood that the extending and release of the jacks is carried out in this cradle by appropriate manipulation of the respective control consoles and levers 23, 24.

The device 4 can be moved in the opposite direction by an opposite pull on the endless member 19.

There are between the cradle 1 and the tower 2, wheels 26 fixed to the cradle 1 on which wheels 26 the cradle 1 can run round the rim 2 which wheels 26 act as stabilising means.

Figure 7:
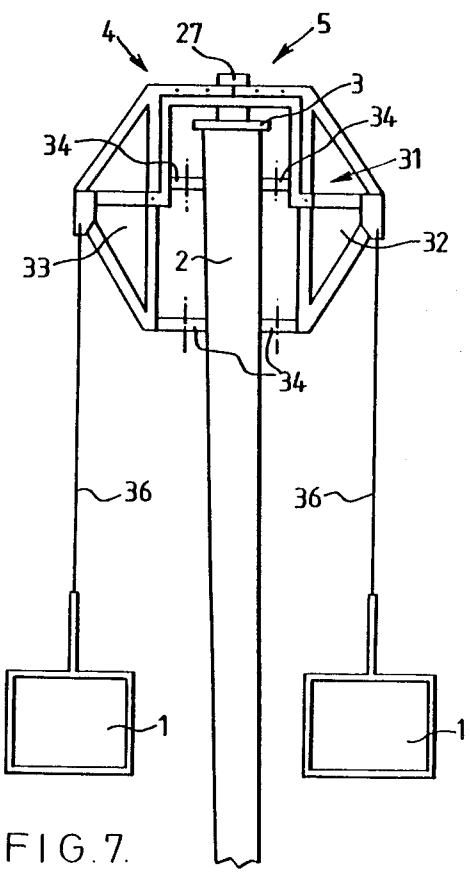
FIG. 7 shows a transverse sectional view of the device of FIG. 6.
Figure 6:
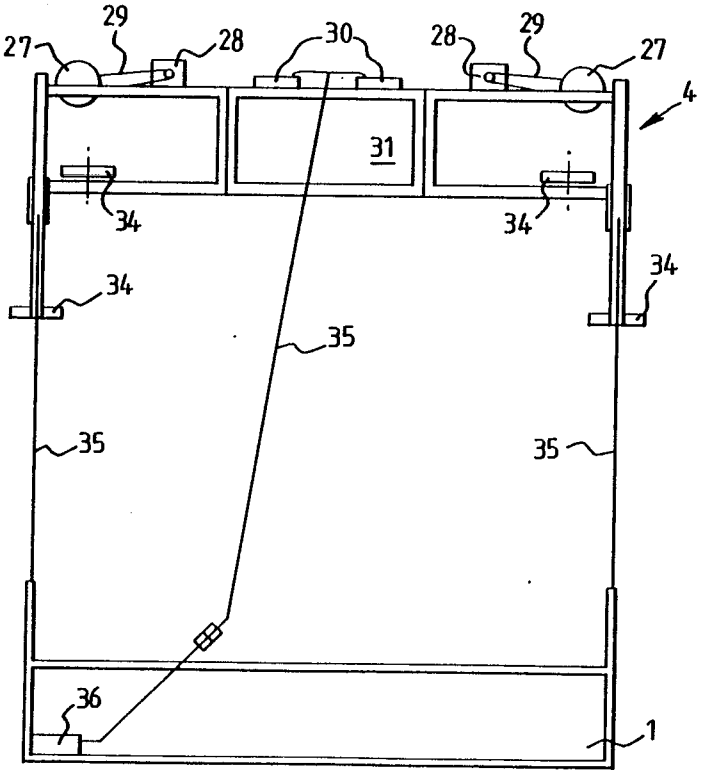
FIG. 6 shows schematically a side elevational view of a second embodiment of device according to the invention.

Referring now to FIGS. 6 and 7, the moving means 5 of the device 4 shown therein comprises two rotatable members such as wheels 27 each of which is driven by its own electric motor 28 via a drive device 29 (such as a chain), the motors 28 each being powered by batteries 30 carried by the device 5. The device 5 itself is a drive frame 31 which is a saddle or inverted U-shaped frame member which straddles the upstanding rim 2 so that the wheels 27 run on the flat, upper, surface 3. The frame 31 thus has an inner frame part 32 and an outer frame part 33, each of which supports a cradle, or platform 1. The cradle 1 produce or provide a balancing influence, and thus stability is enhanced by stabilizing means in the form of rotatable means such as wheels 34 between each frame part 32, 33 and the rim 2. There are four stabilizing wheels 34 on the inside of the tower and four on the outside, the outside ones 34 being spring loaded to allow for variations in wall thickness of the tower rim 2.

The batteries 30 are recharged, via a recharge line 35, a charger 36 carried by a platform or cradle 1 and charging can be carried out when work on the tower is being carried out.

In use, the motors 28 are actuated remotely from a cradle 1 by control means (not shown) to rotate the wheels 27 in the direction to move the device 4 in the required direction around the rim 2 of the cooling tower. Movement in the opposite direction is achieved by rotating the motors 28 in the opposite direction. In either case, the wheels 27 are rotated by their drives 29. The cradle(s) 1 can then be progressed smoothly round the circumference of the rim 2 to enable work such as repair work, painting, maintenance or the like to be carried out.

It will be understood that in both embodiments the cradle(s) 1 can be raised and lowered on a working position by winches 35 and lines 36.

I claim:

1. Apparatus for transporting a suspension cradle along an upper region of an upright edifice having a substantially flat surface extending in a plane transverse to the upright plane of the edifice, comprising:

(i) a device mountable on the surface; and (ii) means adapted to engage the surface for moving the device along said surface, wherein the moving means comprises pairs of extensible members and wherein said members are extended in pairs alternately to engage the surface for moving the device along the surface, wherein there are two pairs of extensible members, and a first frame part and a second frame part of said device, and wherein one pair of said members is carried by said first frame part and the other of said members is carried by the second frame part of the device, and wherein the two frame parts are operatively connected for relative movement, one frame part being within the second frame part and operatively connected by a roller and guide arrangement for relative sliding movement.

2. Apparatus as defined in claim 1 wherein the first frame part includes a carriage having roller bogies one of which is connected to a drive pinion, the second frame part having longitudinally extending inwardly facing channel guide members, in which the rollers of the bogies run so that when the pinion is rotated by a drive device, the first and second frame parts can slide relatively.

3. Apparatus as defined in claim 2, wherein the drive device is a manually rotatable endless member trained around the pinion and a return pulley on the cradle.

4. Apparatus as defined in claim 1, wherein the extensible members are hydraulic jacks each with a pad for contacting said surface.

5. Apparatus as defined in claim 4, wherein the jacks are connected by hydraulic lines to hydraulic actuators carried by the cradle.

6. Apparatus as defined in claim 4, wherein the jacks are connected by hydraulic lines to hydraulic actuators carried by the cradle, and wherein the hydraulic lines include quick release mechanisms.

7. Apparatus as defined in claim 1, wherein said cradle has rotatable means for engaging a boundary surface of the edifice.

* * * * *